United States Patent [19]

Ochs et al.

[11] 4,199,914

[45] Apr. 29, 1980

[54] SEALING MACHINE CLOSURE CAP PICKUP

[75] Inventors: Charles S. Ochs; James M. Herzog, both of Lancaster, Ohio

[73] Assignee: Anchor Hocking Corporation, Lancaster, Ohio

[21] Appl. No.: 940,554

[22] Filed: Sep. 8, 1978

[51] Int. Cl.[2] ..... B65B 7/28; B67B 3/20

[52] U.S. Cl. ..... 53/314; 53/315; 53/317

[58] Field of Search ..... 53/313, 314, 315, 316, 53/317, 331.5

[56] References Cited

U.S. PATENT DOCUMENTS

| | | | |
|---|---|---|---|
| 3,280,534 | 10/1966 | Hilebrandt et al. | 53/315 |
| 3,874,147 | 4/1975 | Zetterberg | 53/314 |
| 3,977,161 | 8/1976 | Faber et al. | 53/313 |

*Primary Examiner*—Travis S. McGehee

*Attorney, Agent, or Firm*—Alexander C. Wilkie, Jr.

[57] ABSTRACT

An improved sealing machine cap pickup is disclosed. The cap pickup is mounted on a sealing machine to feed closure caps onto filled containers being carried through the machine and to lightly turn the caps onto the containers. The pickup includes an improved universally mounted cap guide which directs the caps to a cap applying means such as spaced resiliently mounted and relatively deep cap applying belts or cap rotating friction shoes. Pressure backup plates are positioned above the cap rotating means for urging the caps downwardly at the correct rate as they are turned onto the moving containers.

6 Claims, 10 Drawing Figures

3'
41
5
5'
80
81
83
84
85
87
88
89
90
91
92
93
94
95
96
97
98
99
100
102
103
104
105
106
107
108
109
110
10

SEALING MACHINE CLOSURE CAP PICKUP

BACKGROUND OF THE INVENTION

The present invention relates to container sealing machines and more particularly to an improved closure cap pickup or cap applicator for use in straight line sealing machines for applying closure caps to moving containers.

Container sealing machines, known as straight-line sealing machines, carry filled but unsealed containers beneath a cap feeding means where the closure caps are pulled onto and lightly applied to the container mouths preparatory to a final sealing. Such sealing machines are now being operated at increasing speeds and this improved pickup allows continuous thread closure caps to be correctly applied at significantly increased sealing machine operating speeds. For example, straight line sealing machines have been normally run for many years at average sealing speeds of a magnitude of about 300 containers per minute. Even at these speeds, the cap application has occassionally been unsatisfactory due to the caps being fed in a tilted or cocked position resulting in sealing failures and inconsistent cap application and removal torques.

The improved pickup of the present invention has been successfully run with continuous thread caps at speeds in excess of 1,000 containers per minute with an insignificant number of cocked or tilted closure caps and with consistent cap application torques.

The closure cap pickup, for example, provides for improved operating results over an earlier pickup design as shown in U.S. Pat. No. 3,280,534 owned by the assignee of the present invention.

The improved cap pickup in accordance with the present invention has a novel floating mounting for its closure feeding cap guide allowing the closure to seek the natural center of the container finish. Additionally, the cap rotating means for lightly turning the caps onto the container threads comprises one or two improved moving belts or similarly acting cap rotating friction shoes having floating mountings. The improved pickup provides for better centering of the closure caps on the container finishes regardless of minor imperfections in the containers and also provides for a more positive handling of closure caps as they are removed from the cap feeding chute and are carried into the cap applying belts or other means by the moving containers.

Accordingly, an object of the present invention is to provide an improved cap applicator or pickup for threaded or lug caps.

Another object of the present invention is to provide an improved sealing machine cap pickup capable of operating at significantly increased machine speeds.

Another object of the present invention is to provide an improved cap pickup giving consistent cap application torque values and reduced cap cocking at higher operating speeds.

Another object of the present invention is to provide a sealing machine cap pickup with improved cap control and cap centering on the containers as the caps are carried from a cap feeding chute onto moving containers.

Another object of the present invention is to provide an improved high speed cap applicator particularly adapted for use with continuous thread closure caps.

Other and further objects of the present invention will be apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein.

DESCRIPTION OF THE PREFERRED EMBODIMENT

Figure 1:
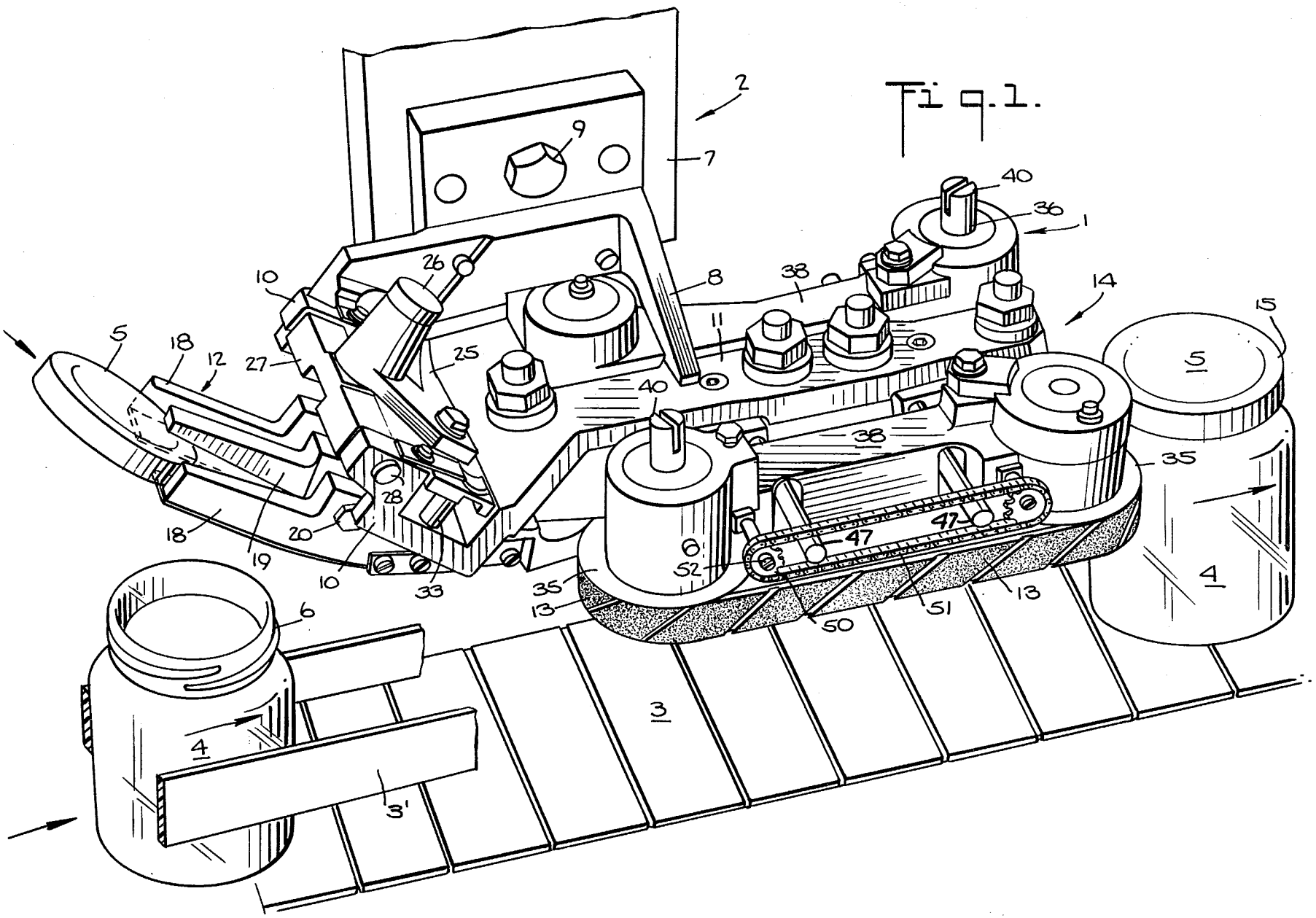
FIG. 1 is a perspective view of a preferred embodiment of the improved cap pickup in accordance with the present invention.

The improved cap pickup will first be described with particular reference to FIG. 1. The pickup 1 is mounted on a straight line sealing machine 2 having a conveyor belt 3 which carries a succession of spaced containers 4 beneath the pickup 1 and between appropriately spaced guide belts 13. FIG. 1, for example, shows a first filled but unsealed container 4 approaching the cap pickup 1 at the left hand side of the figure. The containers 4 are carried into and through the pickup 1. Each container 4 engages and draws a cap 5 onto its open mouth 6 at the pickup 1 and then the pickup 1 centers and levels the cap 5 on the container 4 and lightly turns it to an initially applied or lightly sealed position on the container 4 as illustrated for the container 4 at the right hand side of the FIG. 1.

The cap pickup 1 is mounted on a suitable portion of the sealing machine 2 such as a vertical panel 7. The pickup 1 comprises several portions or sub-assemblies including a mounting bracket 8 which is bolted to sealing machine at 9 and which includes a cap guide support portion 10 and an elongated cap applying belt support portion 11.

A second portion of the cap pickup 1 is a pivotally mounted cap guide 12 which receives caps 5 from an inclined cap feeding chute and which directs the caps 5 into the path of the containers 4 and thereafter guides the caps 4 on the moving containers 4 into engagement with cap applying belts, 13.

A third portion of the cap pickup is the cap applying means 14 including the spaced and driven cap applying belts 13 which engage the cap skirts 15 and turn the caps 5 lightly onto the moving containers, 4.

A fourth portion of the cap pickup 1 is the cap backup or pressure plates 16 (FIG. 4) which engage the covers 17 of the moving caps 5 and urge the caps 5 downwardly onto the containers 4 while the caps are being turned by the cap applying belts 13.

The cap guide 12 comprises a pair of spaced guide rails 18 rigidly connected to each other and to a central guide rail 19 by cross bolts 20 which rigidly couple these members together as a unit. The spaced guide rails 18 include cap support ledges 21 which engage the cap skirts 15. The distance between the facing edges of the ledges 21 is proportioned to admit the threaded upper portion 6 of the moving containers 4 so that each container 4 engages a closure cap 5 which is carried from the cap guide 12 in the manner illustrated in FIG. 4.

This permits the guide rails 18 and the support ledges 21 to be precisely dimensioned for receiving the container tops 6 and for supporting each of the closures 5 by engaging only a minimal outer portion of each cap skirt 15. This close dimensioning and precise spacing between the moving containers 4 and the cap guide 12 is facilitated by a universal pivoting or mounting of the cap guide 12.

Figure 4:
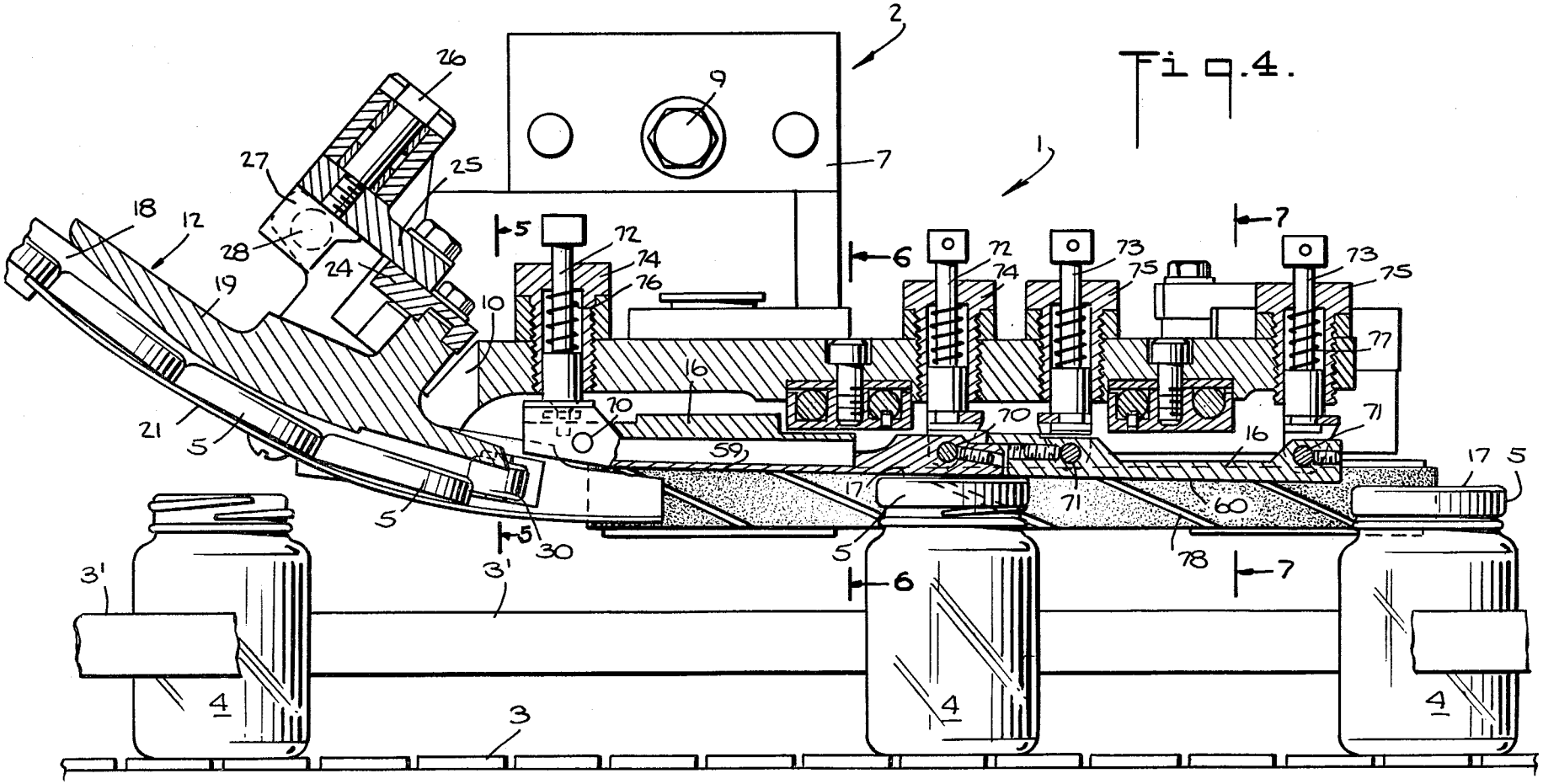
FIG. 4 is a vertical sectional view of the cap pickup.

As best seen in FIG. 4, the center guide rail 19 of the cap guide 12 is bolted to a lateral mounting plate 24 which in turn is bolted to a pivot plate 25. The pivot plate 25 is pivotally attached to the pickup support portion 10 through the intermediation of a pivot pin 26 which includes a lateral mounting member 27 which is pivotally connected on end bearings 28.

Thus, the precise position of the guide rails 18 and of the endmost cap 5 held in the cap guide 12 accomodate themselves to the particular container 4 moving through the cap guide 12 by pivoting about the inclined axis of the pivot pin 26 and also about the horizontal axis of the mounting member 27. These two pivot axes provide a universal adjustment as they are positioned substantially at right angles to one another. An advantage of this pivotal mounting is the elimination of cocked or pinched closures so that the closures 5 are self centering with respect to the moving containers 4 and are positioned both laterally and vertically of the moving containers 4 without cocking or binding. The compensating movement of the cap guide 12 about the horizontal axis of the of the bearings 28, is controlled by a pair of spaced leaf springs 29 engaging the mounting plate 24 and mounted on the support portion 10. The exit ends of the two guide rails 18 are proportioned to extend well into the spaced cap applying belts 13 to facilitate the entry of each moving closure 5 into the belts 13 and the guide rails 18 and the support rails are carefully dimensioned so that the closure skirts 15 move almost immediately into engagement with the side belts 13 as the closure caps 5 are drawn out of the end of the cap guide 12.

Figure 5:
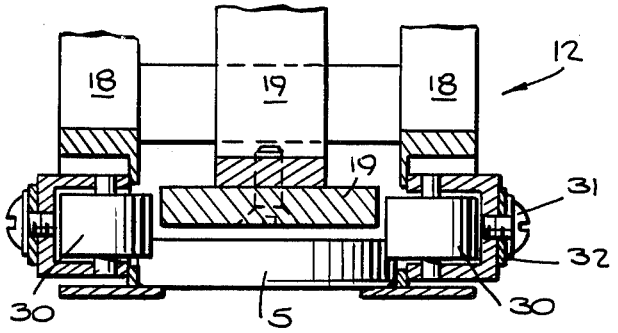
FIG. 5 is a vertical sectional view of the cap pickup taken along line 5—5 of FIG. 4.

The lowermost cap 5 from the cap guide 12 is held at the exit of the cap guide 12, by a pair of spaced spring loaded roller buttons 30. As seen in FIG. 5, the spaced roller buttons 30 are urged inwardly to releasably engage the endmost cap 5 by the screws 31 mounted on leaf springs 32. Once a closure cap 5 is picked up by a container 4, the two roller buttons 30 are forced apart by the moving caps 5 permitting the caps 5 to be pulled out of the cap guide 12.

Figure 2:
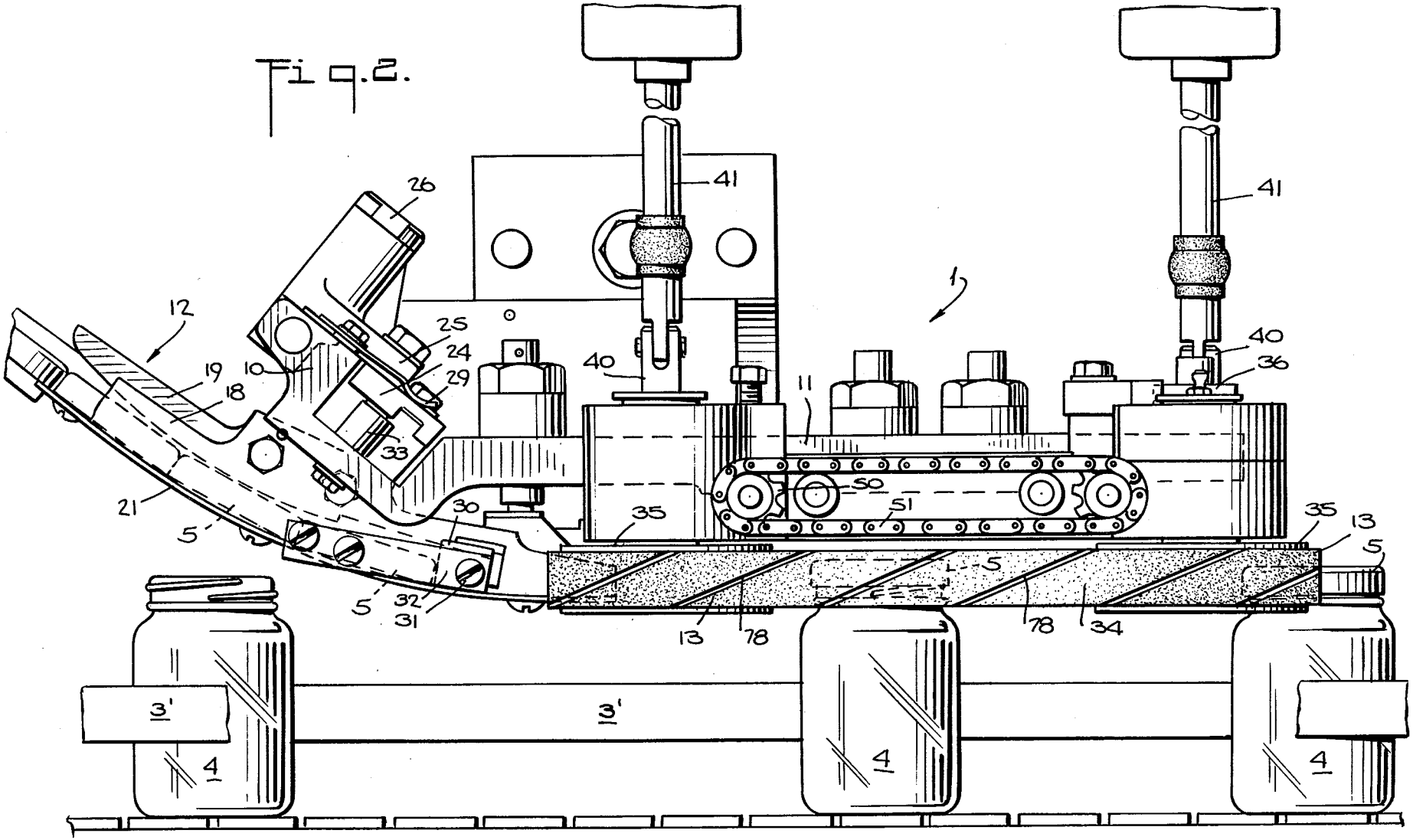
FIG. 2 is a side elevational view, partially in section, of the cap pickup of FIG. 1.

As seen in FIG. 2, the lowermost position of the exit end of the cap guide 12 is determined by a stop member 33 mounted on the support 10 and positioned to engage the support plate 24.

Figure 3:
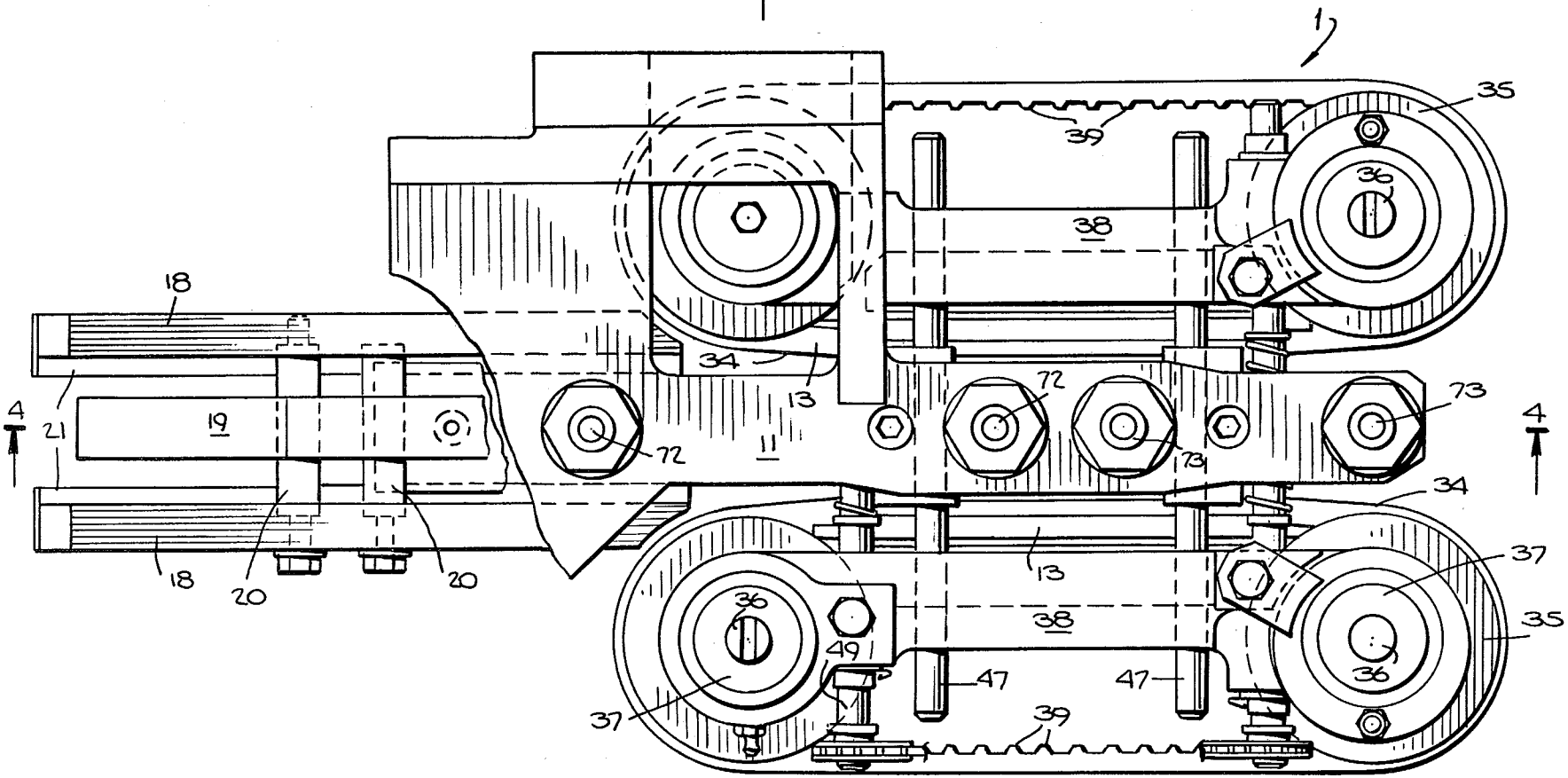
FIG. 3 is a top plan view partially cut away of the cap pickup of FIG. 1.
Figure 6:
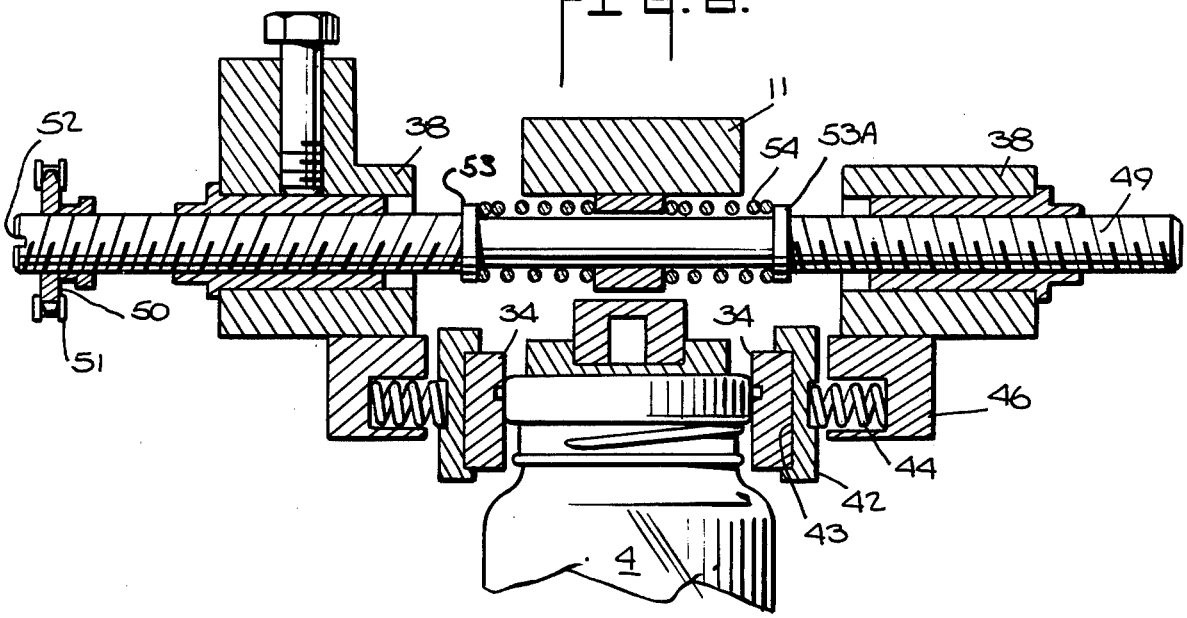
FIG. 6 is a vertical sectional view of the cap pickup taken along line 6—6 of FIG. 4.
Figure 7:
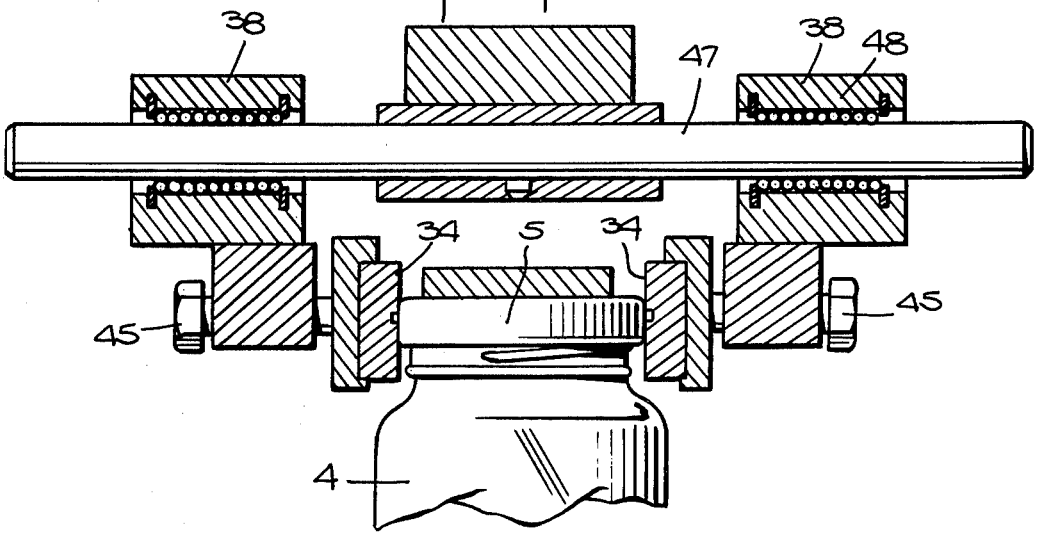
FIG. 7 is a vertical sectional view of the cap pickup taken along line 7—7 of FIG. 4.

The spaced inner runs 34 (FIG. 7) of the endless flexible belts 13 are driven in opposite directions and in a cap applying sense to lightly apply each of the moving caps 5 to a container 4. The belts 13 are formed of a flexible material with a significant surface friction such as rubber or a similar material. Each of the belts 13 is mounted on spaced end pulleys 35 having rotatable shafts 36 mounted in end bearings 37 on the spaced belt supports 38 as illustrated in FIG. 3. Preferably the flexible belts 13 have teeth 39 on their inner runs to provide for positive belt motion. One mounting shaft 36 for each belt has an upwardly extending coupling projection 40 adapted for being coupled to a drive shaft such as a flexible or universal-type drive shaft 41 (FIG. 2). Backup members 42 are provided for the inner runs 34 of the belts 13 as illustrated in FIGS. 6 and 7.

The elongated members 42 contain a belt guiding groove 43 and are loaded by compressed coil springs 44 to hold the belts 13 in frictional engagement with the cap skirts 15. Members 42 are slidably mounted by bolts 45 on brackets 46. The correct spacing of the belts 13 is obtained by changing the spacing of the two belt supports 38. The belt supports 38 are mounted for lateral movement on a pair of spaced support rods 47 (FIGS. 1 and 7) which are provided with a low friction coupling with the supports by ball bearings 48. The spacing adjustment is provided by a pair of spaced and oppositely threaded positioning screws 49 (FIG. 6). The two screws 49 are interconnected by sprocket 50 and chain 51 coupling providing for simultaneous adjustment when one or the other of the screws 49 is turned using its slotted end 52.

An automatic self accomodating lateral movement of the entire belt mounting assembly is provided for by adjustably centering the assembly using compressed coil springs 54 on the adjusting screws 49 between stops 53 and 53A.

In order to provide for a smooth and complete rotation of the caps 5 on the moving containers 4, the inner runs 34 of the belts 13 are made long enough to provide for the necessary degree of rotation of each closure cap 5 on a container 4. Additionally, the vertical dimension of the belts 13 is made equal to the height of the cap skirt 15 plus one cap thread pitch, i.e.; the downward distance which each cap 5 must move in being lightly turned and tightened on the container 4.

A cap leveling and pressure means is provided which extends from the exit ends of the cap guide 12 to the exit end of the cap applying belts 13. This pressure means provides a sloping pressure surface which preferably inclines at the container thread pitch, i.e; the surface urges each cap to move downwardly at the proper rate which results from its being turned lightly onto the container 4 threads by the belts 13.

A preferred embodiment of the pressure means is best illustrated in FIG. 4. The two pressure plates 16 have smooth lower cap engaging surfaces 59 and 60 and have mounting pins 70 and 71 at their opposite ends engaging vertical mounting rods 72 and 73. The four mounting rods 72 and 73 are slidably contained in threadedly attached bearings 74 and 75. Compressed coil springs 76 and 77 urge the mounting rods 72 and 73 and the connected plates 16 downwardly against the closure tops 17. Each closure cap top 17 moves along the lower pressure surfaces of the plates 16 as the caps 5 are turned downwardly by the spaced side belts 13. The slope of the inclined surfaces of the plates 16 correspond to the pitch of the container threads and the container movement so that a downward pressure is continuously maintained on each closure cap as it spins downwardly onto the container threads. Each of the side belts 13 has inclined grooves 78 which are slanted for relative downward movement as they move across the cap skirts 15. The grooves 78 or ribs act both to facilitate cap rotation and to wipe water, such as condensed steam, from the closure cap skirts 15.

Figures 8, 10:
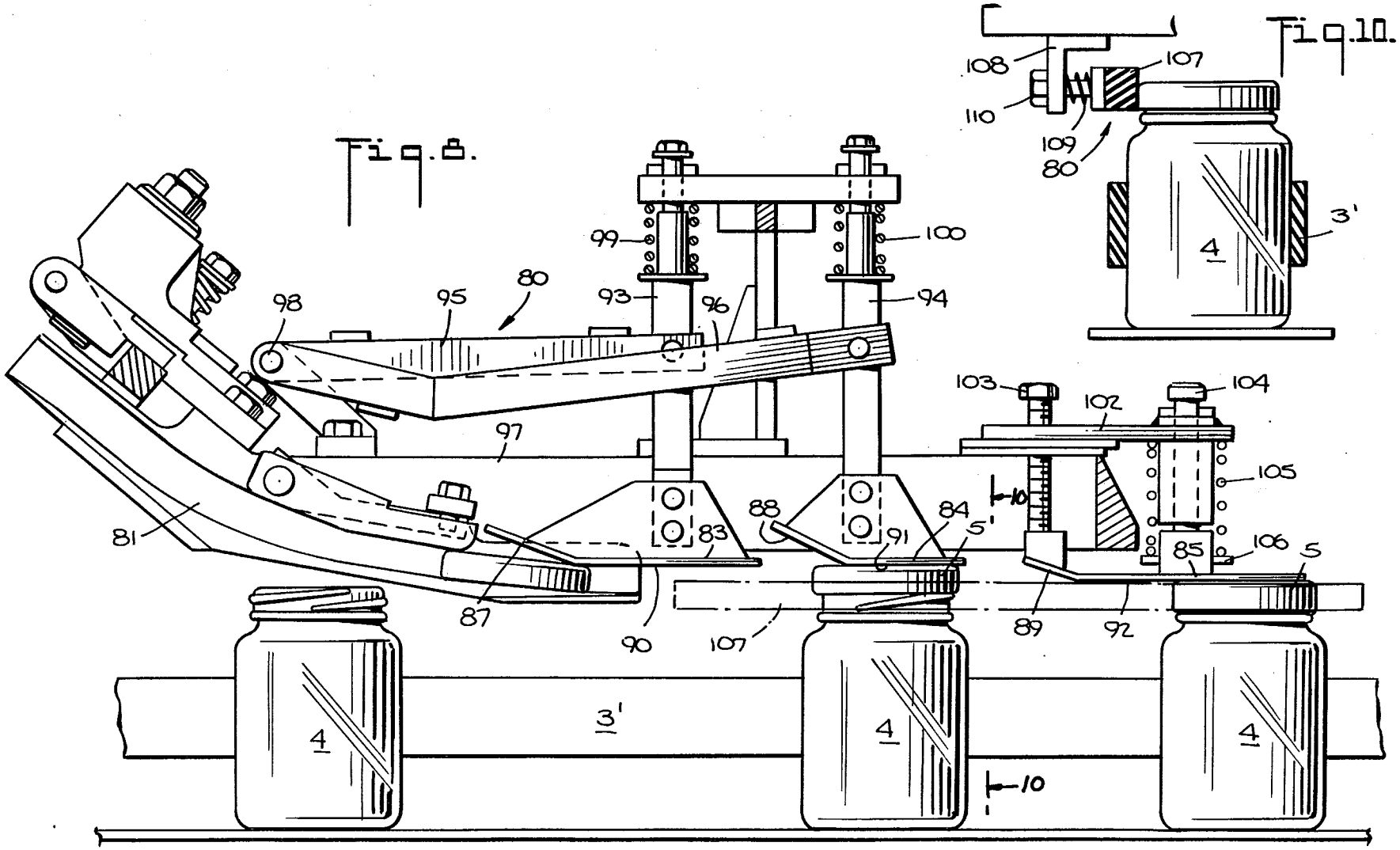
FIG. 8 is a side elevational view of an alternative embodiment of the cap pickup in accordance with the present invention.
FIG. 10 is a vertical sectional view taken along line 10—10 of FIG. 8.
Figure 9:
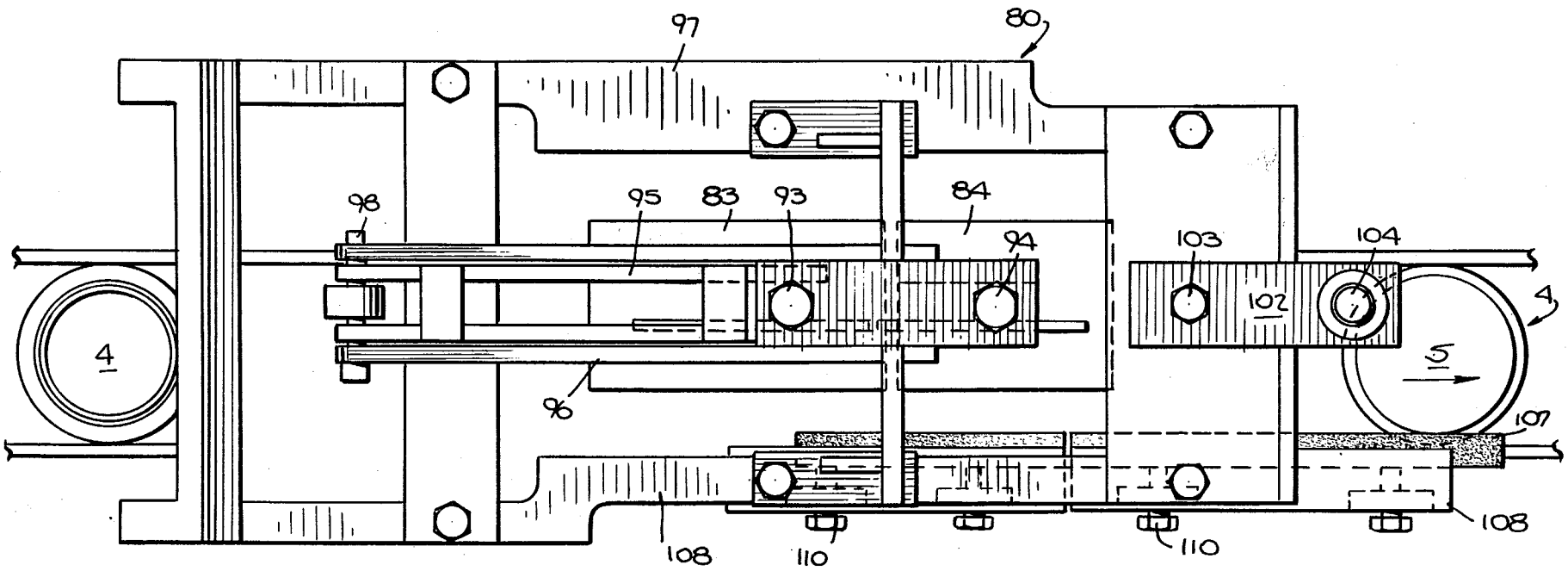
FIG. 9 is a top plan view of the cap pickup of FIG. 8.

FIGS. 8 through 10 illustrate another embodiment of the cap pickup. This pickup 80 uses a cap guide 81 generally similar to the one already described for presenting caps to the moving containers.

Pressure plates 83, 84 and 85 for urging the closure caps 5 downwardly are provided having inclined lead in portions 87, 88 and 89 and relatively flat pressure portions 90, 91 and 92. The plates 83, 84 and 85 are mounted on moveable supports such as a vertical mounting pins 93 and 94 utilized for the first two plates 83 and 84. Each of the pins 93 and 94 is pivotally attached to a hinged support arm 95 or 96. The arms 95 and 96 are pivotally attached to the pickup support section at 98. The compressed coil springs 99 and 100 urge the plates 83 and 84 downwardly against the cap 5 tops. The endmost pressure plate 85 is mounted for vertical movement on a support member 102 on adjustable pins 103 and 104 and is urged downward by a coil spring 105 compressed between the support 102 and a flange 106.

On this embodiment the belts 13 are replaced by an elongated friction member 107. As seen in FIGS. 9 and 10, the friction member 107 is resiliently mounted on an elongated flange 108 and is held against the cap skirt 15 of the moving caps by compressed coil springs 109 on spaced mounting bolts 110.

It will be seen that an improved cap pickup has been disclosed which is capable of operating at higher sealing machine speeds and which is particularly adapted for use with threaded closures such as closures with continuous threads. The improved pickup provides for better cap centering on moving containers and for better cap control as each cap is fed onto and is turned onto a moving container by resiliently mounted side belts or friction means.

As various changes may be made in the form, construction and arrangement of the parts herein without departing from the spirit and scope of the invention and without sacrificing any of its advantages it is to be understood that all matter herein is to be interpreted as illustrative and not in a limiting sense.

What is claimed is:

1. An improved closure cap pickup for applying closure caps to moving containers in a sealing machine having a cap feeding chute comprising the combination of:

a cap guide adapted for being positioned at the lower end of the sealing machine cap feeding chute;

pivot means for mounting the cap guide on the sealing machine for movement about a generally horizontal axis and also about a generally vertically inclined axis;

the lower exit end of the cap guide extending to the entry end of the cap rotating means;

cap rotating means positioned beyond said cap guide for engaging the skirt portions of the closure caps and for turning the caps on containers comprising a pair of spaced endless belts having facing inner runs for engaging opposite sides of the cap skirts;

means mounting said belts for simultaneous movement in the same direction laterally of the moving containers for centering the caps with respect to the belts;

pressure means at said cap rotating means for urging the caps downwardly while they are turned by the cap rotating means;

said belts having vertical widths substantially equal to the height of the cap skirts plus a distance equal to the pitch of the container engaging means on the caps.

2. The cap pickup as claimed in claim 1 in which said cap guide comprises a rigid combination of a pair of spaced guide rails and a central guide rail positioned between said spaced guide rails.

3. The cap pickup as claimed in claim 1 in which said pressure means comprises plate means having a smooth closure cap engaging under surface with said surface inclining downwardly in the direction of cap travel by an amount determined by the pitch of threads on the closure cap.

4. The cap pickup as claimed in claim 3 in which said pressure means is resiliently mounted for vertical movement against the force of a plurality of resilient members.

5. An improved closure cap pickup for applying closure caps to moving containers in a sealing machine having a cap feeding chute comprising the combination of:

a cap guide having a pair of rigidly connected spaced guide rails and a central guide rail and adapted for being positioned at the lower end of the sealing machine cap feeding chute;

pivot means for mounting the cap guide on the sealing machine for movement about a generally horizontal axis and also about a generally vertically inclined axis;

the lower exit end of the cap guide extending to the entry end of the cap rotating means;

cap rotating means positioned beyond said cap guide for engaging the skirt portions of the closure caps and for turning the caps on containers comprising a pair of spaced endless belts having facing inner runs for engaging opposite sides of the cap skirts;

means mounting said belts for simultaneous movement in the same direction laterally of the moving containers for centering the caps with respect to the belts;

pressure means at said cap rotating means for urging the caps downwardly while they are turned by the cap rotating means including plate means having a smooth closure cap engaging surface inclining downwardly in the direction of cap travel by an amount determined by the pitch of the cap threads;

said belts having vertical belt widths substantially equal to the height of the cap skirts plus a distance equal to the pitch of the container engaging means on the caps.

6. The cap pickup as claimed in claim 5 in which said pressure means is resiliently mounted for vertical movement against the force of a plurality of resilient members.

* * * * *